United States Patent [19]

Watanabe et al.

[11] 4,282,312

[45] Aug. 4, 1981

[54] COLOR IMAGE FORMING PROCESS

[75] Inventors: Toshiyuki Watanabe; Takeshi Hirose; Morio Yagihara; Yukio Yokota, all of Minami-ashigara, Japan

[73] Assignee: Fuji Photo Film Co., Ltd., Minami-ashigara, Japan

[21] Appl. No.: 104,999

[22] Filed: Dec. 18, 1979

[30] Foreign Application Priority Data

Dec. 20, 1978 [JP] Japan ..... 53-158916

[51] Int. Cl.[3] ..... G03C 7/00

[52] U.S. Cl. ..... 430/384; 430/385; 430/442

[58] Field of Search ..... 430/384, 385, 442, 484, 430/552, 553

[56] References Cited

U.S. PATENT DOCUMENTS

| | | | |
|---|---|---|---|
| 2,193,015 | 3/1940 | Weissberger | 430/484 |
| 2,552,240 | 5/1951 | Weissberger et al. | 430/484 |
| 2,566,271 | 8/1951 | Weissberger et al. | 430/484 |
| 3,034,892 | 5/1962 | Gledhill et al. | 430/359 |
| 3,576,636 | 4/1971 | Matsui et al. | 430/556 |
| 3,767,411 | 10/1973 | Kishimoto et al. | 430/484 |
| 3,875,227 | 4/1975 | Kroll et al. | 430/484 |
| 3,941,599 | 3/1976 | Busatto et al. | 430/484 |
| 4,009,038 | 2/1977 | Arai et al. | 430/552 |

*Primary Examiner*—J. Travis Brown

*Attorney, Agent, or Firm*—Sughrue, Rothwell, Mion, Zinn and Macpeak

[57] ABSTRACT

A multilayer color photographic material having at least one red sensitive silver halide emulsion layer containing a cyan coupler of the formula (I):

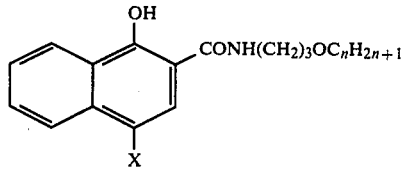

(I)

wherein X represents a hydrogen atom or a chlorine atom and n is a positive integer of 8 to 20, is processed by a color developer containing a developing agent of the formula (II):

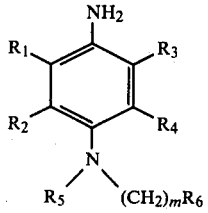

(II)

wherein $R_1$, $R_2$, $R_3$ and $R_4$ each represents a hydrogen atom, a chlorine atom, a methyl group, an ethyl group, a methoxy group or an ethoxy group; $R_5$ represents an alkyl group having 1 to 4 carbon atoms, an alkoxyalkyl group wherein the number of carbon atoms in said alkyl moiety is 1 to 4, or a group of the formula $-(CH_2)_mR_6$; $R_6$ represents a hydroxy group, a methylsulfonamido group, or an ethylsulfonamido group; and m represents a positive integer of 1 to 4.

5 Claims, No Drawings

COLOR IMAGE FORMING PROCESS

BACKGROUND OF THE INVENTION

1. Field of the Invention

This invention relates to a color image forming process which shows good desilvering property and provides color photographic images having high color density when silver halide photographic materials are processed therewith, using a color developer which is less toxic to the human body.

2. Description of the Prior Art

A color developing agent is more or less toxic to the human body and hence it is important for occupational health to select a color developing agent having a low toxicity to the human body. However, in general, a color developing agent having a low toxicity has such demerits that its developing activity is low and the color photographic image has a low color density. To overcome this difficulty, it is necessary to increase the coated amount of silver, but in a red sensitive silver halide emulsion layer, which is usually situated nearest the support, an increase in the coated amount of silver is difficult to remove upon desilvering in a bleaching step.

SUMMARY OF THE INVENTION

An object of this invention is to provide a color image forming process capable of exhibiting good desilvering and providing color images having high color density even using a color developing agent having a less toxic effect on the human body.

The object of this invention can be attained by processing a multilayer color photographic material having at least one red sensitive silver halide emulsion layer containing a cyan coupler of the formula (I):

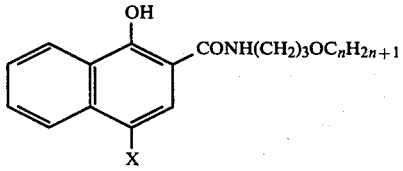

(I)

wherein X represents a hydrogen atom or a chlorine atom and n is a positive integer of 8 to 20, preferably 8 to 14, with a color developer containing a developing agent of the formula (II):

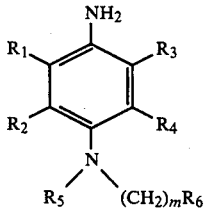

(II)

wherein $R_1$ to $R_4$ each represents a hydrogen atom, a chlorine atom, a methyl group, an ethyl group, a methoxy group, or an ethoxy group; one of said $R_1$ and $R_3$ preferably being a methyl group and the other being a hydrogen group; $R_5$ represents an alkyl group having 1 to 4 carbon atoms, an alkoxyalkyl group wherein the alkyl moiety has 1 to 4 carbon atoms, or $-(CH_2)_mR_6$ where $R_6$ represents a hydroxy group, a methylsulfonamido group or an ethylsulfonamido group; and m is a positive integer of 1 to 4.

DETAILED DESCRIPTION OF THE INVENTION

The color developing agents of the formula (II) have a high solubility in water and hence are less toxic to the human body. However, when color photographic materials containing known cyan couplers are processed by a developer containing the color developing agents of the formula (II) at temperatures higher than 30° C., the color density is greatly reduced. On the other hand, a sufficient color density can be obtained without increasing the amount of silver according to this invention.

Furthermore, in a multilayer color photographic material having a red sensitive silver halide emulsion layer containing the cyan coupler of the formula (I) situated at a position nearer the support than a green sensitive silver halide emulsion layer and a blue sensitive silver halide emulsion layer, it is unnecessary to increase the amount of silver according to this invention even when using the developing agent of the formula (II) and hence desilvering in a bleaching step can be carried out effectively and efficiently.

Practical examples of the cyan couplers of the formula (I) are shown below, however, the present invention is not limited to these examples:

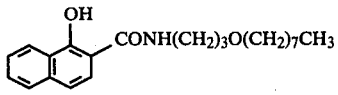

(1)

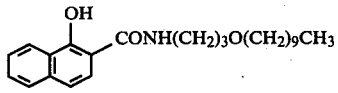

(2)

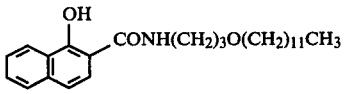

(3)

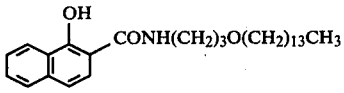

(4)

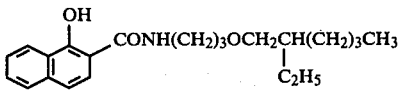

(5)

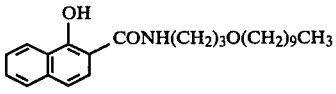

(6)

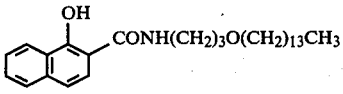

(7)

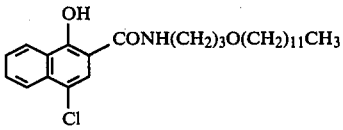

(8)

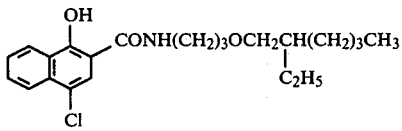

(9)

Representative examples of compounds of the formula (II) are also shown below:

Developer 1

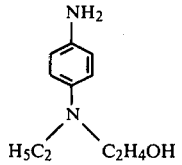

Developer 2

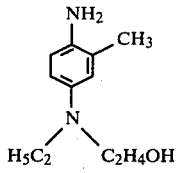

Developer 3

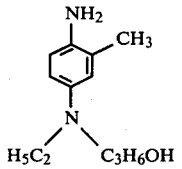

Developer 4

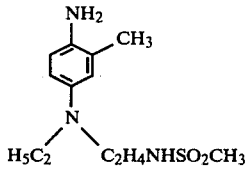

Developer 5

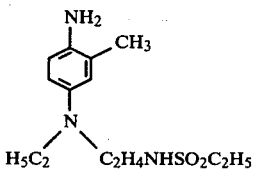

Developer 6

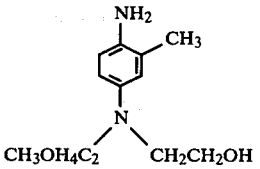

Developer 7

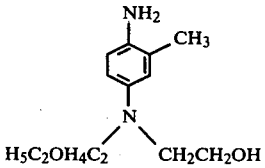

Developer 8

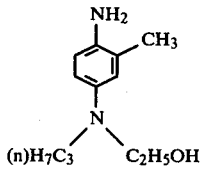

Developer 9

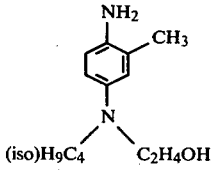

Developer 10

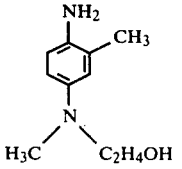

-continued

Developer 11

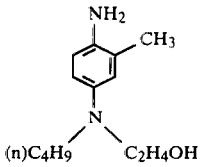

The cyan couplers of the formula (I) are disclosed in Japanese Patent Publication No. 27563/64 but there are neither descriptions nor suggestions of the combination of the cyan couplers and the developing agents of the formula (II) and the effects thereof in that patent specification.

The cyan couplers of the formula (I) can be prepared by the methods described in Japanese Patent Publication No. 27563/64.

The amount of the cyan coupler of the formula (I) incorporated in the silver halide emulsion layer is preferably about 0.005 to 0.5 mol, more preferably about 0.01 to 0.2 mol per mol of silver halide in the silver halide emulsion layer. The amount of the silver halide in the silver halide emulsion layer containing the cyan coupler of the formula (I) may be about $3\times10^{-3}$ to $3\times10^{-1}$ mol per square meter in negative color photographic films and about $9\times10^{-5}$ to $3\times10^{-2}$ mol per square meter in color photographic papers.

In this invention, other cyan couplers may be used together with the cyan couplers of the formula (I) such as phenolic compounds and naphtholic compounds. Practical examples of these compounds are described in U.S. pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411 and 4,004,929, German Patent Application (OLS) Nos. 2,414,830 and 2,454,329, Japanese Patent Application (OPI) Nos. 59838/73 (The term "OPI" as used herein refers to a "published unexamined Japanese patent application"), 26034/76, 5055/73 and 146828/76. The ratio of the couplers is not particularly limited, although higher proportions of the coupler of the formula (I) seem to give better results.

For making the color photographic materials used in this invention, well known couplers other than the cyan forming couplers can also be used. It is preferred that the coupler used in this invention have a hydrophobic group (a so-called ballast group) in the molecule. The coupler may be a four equivalent coupler or a two equivalent coupler. The color photographic materials used in this invention may further contain colored couplers having color correction effect or couplers releasing a development inhibitor upon development (so-called DIR couplers). The use of DIR couplers in combination with the above cyan coupler is disclosed in commonly assigned U.S. application Ser. No. 098,089 filed on Nov. 28, 1979 corresponding to Japanese Patent Application No. 146744/78, filed Nov. 28, 1978 which is incorporated herein by reference. Furthermore, couplers forming colorless products by coupling reactions may also be used.

As yellow color couplers, conventional open chain type ketomethylenic couplers can be used. Among these couplers, benzoylacetanilido series compounds and pivaloylacetanilido series compounds are advantageously used. Practical examples of the yellow color couplers suitable for use in this invention are described in U.S. Pat. Nos. 2,875,057, 3,265,506, 3,408,194, 3,551,155, 3,582,322, 3,725,072 and 3,891,445, West German Pat. No. 1,547,868, German Patent Application (OLS) Nos. 2,219,917, 2,261,361 and 2,414,006, British Pat. No. 1,425,020, Japanese Patent Publication No. 10783/76 and Japanese Patent Application (OPI) Nos. 26133/72, 73147/73, 102636/76, 6341/75, 123342/75, 130442/75, 21827/76 and 87650/75.

As magenta color couplers, pyrazolone series compounds, indazolone series compounds, cyanoacetyl compounds, etc., can be used and, in particular, pyrazolone series compounds are advantageous. Practical examples of magenta color couplers used in this invention are described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, West German Pat. No. 1,810,464, German Patent Application (OLS) Nos. 2,408,665, 2,417,945, 2,418,959 and 2,424,467, Japanese Patent Publication Nos. 6031/65 and 45990/76, and Japanese Patent Application (OPI) Nos. 20826/76, 58922/77, 129538/74, 74027/74, 159336/75, 42121/77, 74028/74, 60233/75 and 26541/76.

Examples of colored couplers useful in this invention are described in, for example, U.S. Pat. Nos. 3,476,560, 2,521,908 and 3,034,892, Japanese Patent Publication Nos. 2016/69, 22335/63, 11304/67 and 32461/69, Japanese Patent Application (OPI) Nos. 26034/76 and 42121/77, and German Patent Application (OLS) No. 2,418,959.

Examples of DIR couplers used in this invention are described in, for example, U.S. Pat. Nos. 3,227,554, 3,617,291, 3,701,783, 3,790,384, and 3,632,345, German Patent Application (OLS) Nos. 2,414,006, 2,454,301 and 2,454,329, British Pat. No. 953,454, Japanese Patent Application (OPI) Nos. 69624/77, 122335/74 and 69624/77 and Japanese Patent Publication no. 16141/76.

The color photographic materials used in this invention may further contain compounds releasing a development inhibitor upon development in addition to the DIR couplers and practical examples of these compounds are described in, for example, U.S. Pat. Nos. 3,297,445 and 3,379,529, German Patent Application (OLS) No. 2,417,914, Japanese Patent Application (OPI) Nos. 15271/77 and 9116/78.

The above-mentioned couplers may be incorporated in the same silver halide emulsion layer in combinations of two or more and further the same coupler may be incorporated in two or more photographic emulsion layers.

For incorporating the above-mentioned couplers in silver halide emulsions, known methods such as described in, for example, U.S. Pat. No. 2,322,027 may be used. For example, the coupler may be dissolved in a phthalic acid alkyl ester (dibutyl phthalate, dioctyl phthalate, etc.), a phosphoric acid ester (diphenyl phosphate, triphenyl phosphate, tricresyl phosphate, dioctylbutyl, phosphate, etc.), a benzoic acid ester (e.g., octyl benzoate, etc.), a citric acid ester (e.g., tributyl acetylcitrate, etc.), an alkylamide (e.g., diethyllaurylamide, etc.), or a fatty acid ester (e.g., dibutoxyethyl succinate, dioctyl azelate, etc.) or in an organic solvent having a boiling point of about 30° to 150° C., such as a lower alkyl acetate (e.g., ethyl acetate, butyl acetate, etc.), ethyl propionate, secondary butyl alcohol, methyl isobutyl ketone, β-ethoxyethyl acetate, methylcellosolve acetate, and then the solution is dispersed in hydrophilic colloid. A mixture of the above-mentioned high boiling organic solvent and the low-boiling organic solvent may be used. When the coupler possesses an acid group such as a carboxylic acid group, a sulfonic acid group, etc., it may be incorporated in a hydrophilic colloid as an aqueous alkaline solution thereof.

The photographic emulsions of the present invention may be spectrally sensitized with methine dyes or the like. Examples of suitable dyes which can be used include cyanine dyes, merocyanine dyes, complex cyanine dyes, complex merocyanine dyes, holopolar cyanine dyes, hemicyanine dyes, styryl dyes and hemioxonol dyes. Particularly preferred dyes are cyanine dyes, merocyanine dyes and complex merocyanine dyes. These dyes may contain nuclei commonly used as basic heterocyclic nuclei in cyanine dyes. Namely, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus or a pyridine nucleus; nuclei wherein an alicyclic hydrocarbon ring is fused to the above-described nuclei; and nuclei wherein an aromatic hydrocarbon ring is fused to the above-described nuclei, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus or a quinoline nucleus, etc., can be employed. The carbon atoms of these nuclei may be substituted with substituents.

The merocyanine dyes or complex merocyanine dyes may contain 5- or 6-membered heterocyclic rings such as a pyrazolin-5-one nucleus, a thiohydantoin nucleus, a 2-thioxazolidin-2,4-dione nucleus, a thiazolidin-2,4-dione nucleus, a rhodanine nucleus or a thiobarbituric acid nucleus, etc.

Useful sensitizing dyes are those described in German Pat. No. 929,080, U.S. Pat. Nos. 2,231,658, 2,493,748, 2,503,776, 2,519,001, 2,912,329, 3,656,959, 3,672,897, 3,694,217, 4,025,349 and 4,046,572, British Pat. No. 1,242,588 and Japanese Patent Publication Nos. 14030/69 and 24844/77.

These sensitizing dyes may be used individually or as a combination thereof. Combinations of sensitizing dyes are often used for the purpose of supersensitization. Typical examples of such combinations are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, British Pat. Nos. 1,344,281 and 1,507,803, and Japanese Patent Publication Nos. 4936/68, 12375/78, 110618/77 and 109925/77.

The emulsions may contain dyes which do not have a spectral sensitization function themselves or materials which do not substantially absorb visible light but give rise to a supersensitization together with the sensitizing dyes. For example, aminostilbene compounds substituted with a nitrogen containing heterocyclic group (such as those described in, for example, U.S. Pat. Nos. 2,933,390 and 3,635,721), aromatic organic acid-formaldehyde condensation products (for example, those described in U.S. Pat. No. 3,743,510), cadmium salt and azaindene compounds may be employed. The combinations described in U.S. Pat. Nos. 3,615,613, 3,615,641, 3,617,295 and 3,635,721 are particularly useful.

The color developer is used in the present invention in conventional amounts (e.g., 0.1 to 20 g/l and preferably 1 to 10 g/l) and at a conventional pH (e.g., 8 to 13 and preferably 10 to 12). The color developer containing the color developing agent represented by the general formula (II) may further contain known developer components. For example, alkalis and buffers such as sodium hydroxide, potassium hydroxide, sodium carbonate, potassium carbonate, sodium tertiary phosphate, potassium tertiary phosphate, potassium metaborate, borax, etc., and they may be used individually or as a combination thereof. Also, for the purpose of imparting a buffering faculty, for the convenience of the preparation of the color developer, and for increasing the ion strength, hydrogen disodium phosphate, hydrogen dipotassium phosphate, dihydrogen potassium phosphate, dihydrogen sodium phosphate, sodium hydrogencarbonate, potassium hydrogencarbonate, boric acid, an alkali nitrate, an alkali sulfate, etc., may be added to the color developer.

Also, the color developer may further contain, if necessary, any desired development promoters, for example, various pyridinium compounds and other cationic compounds as described in U.S. Pat. No. 2,648,604, Japanese Patent Publication No. 9503/69 and U.S. Pat. No. 3,671,247; cationic dyes such as phenosafranine, etc.; neutral sites such as thallium nitrate, potassium nitrate, etc.; polyethylene glycol and the derivatives thereof as described in Japanese Patent Publication No. 9504/69 and U.S. Pat. Nos. 2,533,990, 2,531,832, 2,950,970 and 2,577,127; nonionic compounds such as polythioethers, etc.; the organic solvents, organic amines, ethanolamine, ethylenediamine, diethanolamine, etc., as described in Japanese Patent Publication No. 9509/69 and Belgian Pat. No. 682,862; as well as promoters described in L. F. A. Mason, *Photographic Processing Chemistry,* pages 40–43 (Focal Press, London, 1966). Also, benzyl alcohol and phenylethyl alcohol as described in U.S. Pat. No. 2,515,147 and pyridine, ammonia, hydrazine, and amines described in *Journal of the Society of Photographic Science and Technology and Japan,* Vol. 14, page 74 (1952) are used as useful development promoters. The development promoter can be used in a conventional amount such as 0.01 to 10 g/l.

Still further, the color developers used in this invention may further contain sodium sulfite, potassium sulfite, potassium hydrogensulfite, or sodium hydrogensulfite usually used as preservatives.

The color developers used in this invention may further contain, if necessary, desired antifoggants. As the antifoggants, there are alkali metal halides such as potassium bromide, sodium bromide, potassium iodide, etc., and organic antifoggants. Examples of the organic antifoggants used in this invention are nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, etc.; mercapto-substituted heterocyclic compounds such as 1-phenyl-5-mercaptotetrazole, 2-mercaptobenzimidazole, 2-mercaptobenzothiazole, etc.; and mercapto-substituted aromatic compounds such as thiosalicyclic acid, etc. Nitrogen-containing heterocyclic compounds, in particular, nitrogen-containing heterocyclic compounds which have not been substituted by mercapto are preferred. The amount of the antifoggant is 1 mg to 5 g, preferably 5 mg to 1 g per liter of the color developer.

Furthermore, polyphosphoric acid compounds such as sodium hexametaphosphate, sodium tetrapolyphosphate, sodium tripolyphosphate and the potassium salts of the aforesaid polyphosphoric acids and aminopolycarboxylic acids such as ethylenediaminetetraacetic acid, nitrilotriacetic acid, cyclohexanediaminetetraacetic acid, iminodiacetic acid, N-hydroxymethylethylenediaminetriacetic acid, diethylenetriaminepentaacetic acid, etc., can be used as a water softener in the color developer of this invention. The amount of the compound depends upon the hardness of water used but usually 0.5 to 1 g/l. Moreover, calcium or magnesium masking agents may be also used in the photographic processing solution. They are described in detail in J. Willems, *Belgische Chemische Industrie,* Vol. 21, page 325 (1956), and ibid., Vol. 23, page 1105 (1958).

Furthermore, the color developers used in this invention may further contain the polycarboxylate series chelating agents described in U.S. Pat. No. 4,083,723 and the antioxidants described in German Patent Application (OLS) NO. 2,622,950.

The photographic silver halide emulsion layers are usually bleached after color development. A bleaching process may be performed simultaneously with fixing or performed separately. As a bleaching agent, compounds of polyvalent metals such as iron (III), cobalt (III), chromium (IV), copper (II), etc.; peroxy acids; quinones; and nitroso compounds are used. For example, ferricyanides; dichromates; organic complex salts of iron (III) or cobalt (III); complex salts of aminopolycarboxylic acids such as ethylenediaminetetraacetic acid, nitrilotriacetic acid, 1,3-diamino-2-propanoltetraacetic acid, etc., or organic acids such as citric acid, tartaric acid, malic acid, etc.; persulfates; permanganates; nitrosophenol, etc. Among these compounds, potassium ferricyanide, ethylenediaminetetraacetic acid iron (III) sodium and ethylenediaminetetraacetic acid iron (III) ammonium are particularly useful. The ethylenediaminetetraacetic acid iron (III) complex salts are useful not only in a bleaching solution but also a mono-bath type blix solution.

The bleaching solution or blix solution may further contain the bleaching promoters as described in U.S. Pat. Nos. 3,042,520 and 3,241,966, and Japanese Patent Publication Nos. 8506/70 and 8836/70 and also the thiol compounds as described in Japanese Patent Application (OPI) No. 65732/78.

EXAMPLE 1

The silver halide emulsion (A) prepared as described below was coated on a cellulose triacetate support having a subbing layer at a silver coverage of 2.25 g/m$^2$ and then a protective layer was formed thereon to provide a sample [A].

Silver halide emulsion (A):

The silver halide emulsion (A) was prepared by dissolving 100 g of 1-hydroxy-2-[β-(2,4-di-t-amylphenoxy)butyl]naphthamide (comparison coupler) in a mixture of 100 ml of dibutyl phthalate and 100 ml of ethyl acetate, mixing the solution with 1 kg of an aqueous 10% gelatin solution with stirring at high speeds to provide an emulsion, and then mixing 350 g of the emulsion prepared with 1 kg of a red sensitive silver iodobromide emulsion (containing 50 g of silver, 60 g of gelatin, and 6 mol % iodine).

The protective layer was formed by coating an aqueous 5% gelatin solution on the silver halide emulsion layer at a dry thickness of 1 micron.

Also, silver halide emulsions (B), (C), (D), (E) and (F) were prepared in the same manner as in the case of preparing the silver halide emulsion (A) using the following cyan couplers in place of the above-mentioned coupler in an equimolar amount and, samples [B], [C],

[D], [E] and [F] were also prepared in the same manner as sample [A] using the silver halide emulsions.

| Silver Halide Emulsion | Cyan Coupler Used |
|---|---|
| (B) | (7) |
| (C) | (3) |
| (D) | (6) |
| (E) | (1) |
| (F) | (5) |

Each of the samples [A] to [F] was stepwise exposed to white light and then processed by the following processing:

| Processing I (at 38° C.) | Time |
|---|---|
| 1. Color development | 3 min 15 sec |
| 2. Bleach | 6 min 30 sec |
| 3. Wash | 3 min 15 sec |
| 4. Fix | 6 min 30 sec |
| 5. Wash | 3 min 15 sec |
| 6. Stabilization | 3 min 15 sec |

The compositions of the processing solutions used in the above processing were as follows:

| | |
|---|---|
| Color Developer | |
| Sodium Nitrotriacetate | 1.0 g |
| Sodium Sulfite | 4.0 g |
| Sodium Carbonate | 30.0 g |
| Potassium Bromide | 1.4 g |
| Hydroxylamine Sulfate | 2.4 g |
| 4-(N-Ethyl-N-β-hydroxyethylamino)-2-methylaniline Sulfate | 4.5 g |
| Water to make | 1 l |
| Bleach Solution | |
| Ammonium Bromide | 160.0 g |
| Aqueous Ammonia (28%) | 25.0 ml |
| Ethylenediaminetetraacetic Acid Sodium Iron Salt | 130 g |
| Glacial Acetic Acid | 14 ml |
| Water to make | 1 l |
| Fix Solution | |
| Sodium Tetrapolyphosphate | 2.0 g |
| Sodium Sulfite | 4.0 g |
| Ammonium Thiosulfate (70%) | 175.0 ml |
| Sodium Hydrogensulfite | 4.6 g |
| Water to make | 1 l |
| Stabilization Solution | |
| Formalin | 8.0 ml |
| Water to make | 1 l |

The sample [A] was also processed in the same manner as Processing I except that 4-(N,N-diethylamino)-2-methylaniline hydrochloride was used in place of the color developing agent in the color developer in Processing I (Processing II).

The density of the samples thus processed was measured using red light, the results being shown as follows.

| Sample | Coupler | Density at the Gradation Part of the Density Curve | Processing |
|---|---|---|---|
| [A] | Comparison coupler | 1.82 | I |
| [B] | (7) | 2.18 | I |
| [C] | (3) | 2.22 | I |

-continued

| Sample | Coupler | Density at the Gradation Part of the Density Curve | Processing |
|---|---|---|---|
| [D] | (6) | 2.31 | I |
| [E] | (1) | 2.29 | I |
| [F] | (5) | 2.30 | I |
| [A] | Comparison coupler and developer | 2.16 | II |

From the results, it will be understood that in the case of using the comparison coupler, 1-hydroxy-2-[γ-(2,4-di-t-amylphenoxy)butyl]naphthamide, the color density was reduced from 2.16 (Processing II) to 1.82 when developed by a color developer containing the developing agent having a weak toxicity used in this invention and in this case it was required to increase the amount of silver by about 20% for keeping the original color density, while in the case of using the color photographic material of this invention, a sufficient color density was obtained by processing in Processing I using the developing agent having a weak toxicity.

EXAMPLE 2

Sample [G] was prepared by forming successively the following layers on a cellulose triacetate support having a subbing layer.

1st layer (antihalation layer):

An aqueous 6% gelatin solution containing black colloid silver (silver content 50 g/kg) was coated at a dry thickness of 1 micron.

2nd layer (interlayer):

In a mixture of 100 g of tricresyl phosphate and 200 g of ethyl acetate was dissolved 100 g of 2,5-di-t-octylhydroquinone, the solution was mixed with 1 kg of an aqueous 10% gelatin solution containing 1 g of potassium dodecylbenzenesulfonate with stirring forcibly by means of a high speed homogenizer to provide an emulsion, 100 g of the emulsion prepared was mixed with 1 kg of an aqueous 6% gelatin solution, and after adding thereto 50 ml of an aqueous solution of 2% 2-hydroxy-4,6-dichloro-s-triazine sodium salt as a gelatin hardening agent, the resultant mixture was coated at a dry thickness of 1 micron.

3rd layer (red sensitive silver halide emulsion layer):

The silver halide emulsion (C) prepared in Example 1 was coated at a silver coverage of 20 mg/100 cm$^2$. In addition, the silver halide emulsion contained 50 ml of an aqueous solution of 2% 2-hydroxy-4,6-dichloro-s-triazine sodium salt as a hardening agent for gelatin.

4th layer (interlayer):

Same as the 2nd layer.

5th layer (green sensitive silver halide emulsion layer):

To 1 kg of a green sensitive silver iodobromide emulsion were added 300 g of emulsion (M) having the following composition and 50 ml of an aqueous solution of 2-hydroxy-4,6-dichloro-s-triazine sodium salt as a gelatin hardening agent, the mixture was coated at a silver coverage of 20 mg/100 cm$^2$.

| Emulsion (M): | |
|---|---|
| (1) Aqueous 10% Gelatin Solution | 1 kg |
| (2) The magenta coupler shown below | 60 g |
| Ethyl Acetate | 110 ml |

-continued

Emulsion (M):

| | |
|---|---|
| Tricresyl Phosphate | 65 ml |
| Sodium p-Dodecylbenzenesulfonate | 5 g |

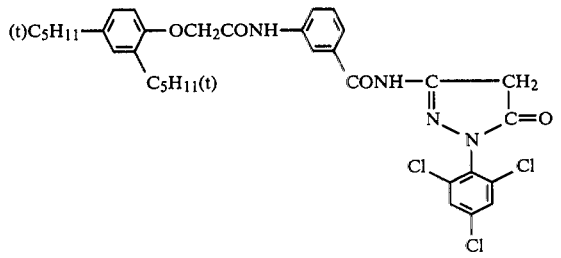

6th layer (yellow filter layer):

To 1 kg of an aqueous 6% gelatin solution containing 8 g of Carey-Lea type yellow colloid silver was added 50 ml of an aqueous solution of 2% 2-hydroxy-4,6-dichloro-s-triazine sodium salt and the mixture was coated at a dry thickness of 2 microns.

7th layer (blue sensitive silver halide emulsion layer):

To 1 kg of a silver iodobromide emulsion (containing 6.5 g of silver iodobromide (iodine 7 mol%) and 10 g of gelatin) were added 800 g of emulsion (Y) having the following composition and 50 ml of an aqueous solution of 2% 2-hydroxy-4,6-dichloro-s-triazine sodium salt and the mixture was coated at a silver coverage of 10 mg/100 cm$^2$.

Emulsion (Y):

| | | |
|---|---|---|
| (1) | Aqueous 10% Gelatin Solution | 1 kg |
| (2) | The yellow coupler shown below | 100 g |
| | Ethyl Acetate | 120 ml |
| | Sodium p-Dodecylbenzenesulfonate | 5 g |
| | Tricresyl Phosphate | 65 ml |

Yellow Coupler:

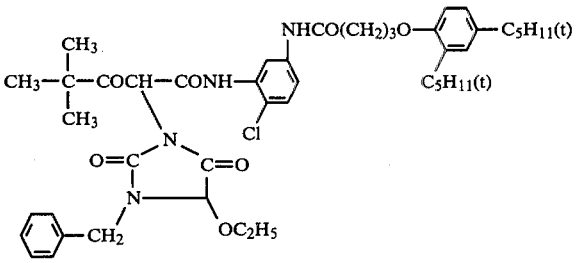

8th layer (gelatin protective layer):

To 1 kg of an aqueous 6% gelatin solution was added 50 ml of an aqueous solution of 2% 2-hydroxy-4,6-dichloro-s-triazine sodium salt and the mixture was coated at a dry thickness of 1 micron.

Furthermore, sample [H] was prepared by the same manner as the case of preparing the sample [G] except that the silver halide emulsion (A) in Example 1 was used in place of the silver halide emulsion (C) in the 3rd layer and the emulsion was coated at a silver coverage of 24.5 mg/100 cm$^2$.

Each of the samples [G] and [H] was processed using Processing I described in Example 1.

The density of the red sensitive silver halide emulsion layer of the samples thus processed was measured using red light and desilvering property was also investigated. In the sample [H], desilvering was insufficient when bleaching for 6 minutes and 30 seconds and it required a bleaching period of 9 minutes for desilvering to an extent of practical use. The maximum density in this case was 1.97. On the other hand, in the sample [G], desilvering could be performed sufficiently by the bleaching in 6 minutes and 30 seconds and the maximum density in this case was 1.94.

While the invention has been described in detail and with reference to specific embodiments thereof, it will be apparent to one skilled in the art that various changes and modifications can be made therein without departing from the spirit and scope thereof.

What is claimed is:

1. An image forming process which comprises processing a multilayer color photographic material having at least one red sensitive silver halide emulsion layer containing a cyan coupler of the formula (I):

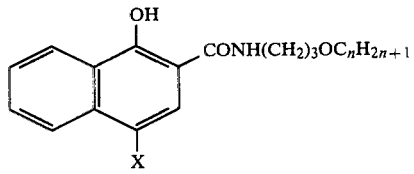

(I)

wherein X represents a hydrogen atom or a chlorine atom and n is a positive integer of 8 to 20, with a color developer containing a developing agent of the formula (II):

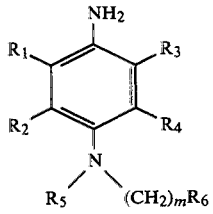

(II)

wherein $R_1$, $R_2$, $R_3$ and $R_4$ each represents a hydrogen atom, a chlorine atom, a methyl group, an ethyl group, a methoxy group, or an ethoxy group; $R_5$ represents an alkyl group having 1 to 4 carbon atoms, an alkoxyalkyl group wherein the number of carbon atoms in the alkyl moiety is 1 to 4, or a $-(CH_2)_mR_6$ group where $R_6$ represents a hydroxy group, a methylsulfonamido group, an ethylsulfonamido group; and m is a positive integer of 1 to 4.

2. The process of claim 1, wherein one of $R_1$ and $R_3$ is a methyl group and the other is a hydrogen atom.

3. The process of claim 1, wherein said photographic material contains said cyan coupler in an amount of about 0.005 to 0.5 mol per mol of silver halide in the red sensitive silver halide emulsion layer.

4. The process of claim 1, wherein X is hydrogen.

5. The process of claim 1, wherein X is chlorine.

* * * * *